United States Patent [19]

Hille

[11] Patent Number: 4,898,057

[45] Date of Patent: Feb. 6, 1990

[54] LOW VIBRATION CENTER DRIVE CUTTER CHAIN

[75] Inventor: Arvin A. Hille, Lake Oswego, Oreg.

[73] Assignee: Blount, Inc.

[21] Appl. No.: 365,601

[22] Filed: Jun. 13, 1989

[51] Int. Cl.[4] ..... B27B 33/14

[52] U.S. Cl. ..... 83/831; 83/833; 83/834

[58] Field of Search ..... 83/830, 831, 832, 833, 83/834; 30/381, 382

[56] References Cited

U.S. PATENT DOCUMENTS

| | | | |
|---|---|---|---|
| 4,122,741 | 10/1978 | Engman et al. | 83/834 |
| 4,567,803 | 2/1986 | Anderson | 83/833 |
| 4,590,836 | 5/1986 | Doiron | 83/834 |
| 4,604,932 | 8/1986 | Doiron | 83/830 |
| 4,608,901 | 9/1986 | Doiron | 83/834 |
| 4,643,065 | 2/1987 | MacGavin | 83/830 |
| 4,756,221 | 7/1988 | Nitschmann et al. | 83/833 |

*Primary Examiner*—Donald R. Schran
*Attorney, Agent, or Firm*—Klarquist, Sparkman, Campbell, Leight & Whinston

[57] ABSTRACT

A center drive cutter chain for mounting on a cutter bar. The chain comprises center drive cutter links having forward and rearward pivot openings and pairs of oppositely disposed side links pivotally interconnected by pins to the cutter links and alternating non-cutter drive links. The side links each have forward and rearward pivot openings and forward and rearward bar engaging undersides. For the side links following a center drive link, the width of each side link between its forward pivot opening and forward bar engaging underside is less than the width between its rearward pivot opening and rearward bar engaging underside. When the axes of the pins extending through the pivot openings of the cutter links and following side links are substantially in a plane, the forward bar engaging undersides of the side links are spaced apart from the adjacent side rails of the bar. This spacing enables the center cutter link to pivot about its forward pivot opening to reduce the penetration of the cutter tooth into the workpiece, thereby reducing the vibration of the chain when the cutter link encounters resistance in a workpiece.

4 Claims, 1 Drawing Sheet

LOW VIBRATION CENTER DRIVE CUTTER CHAIN

BACKGROUND OF THE INVENTION

This invention relates generally to saw chain and, more particularly, to an improved center drive cutter chain for cutting wood.

Conventional saw chain generally includes a series of center drive links with depending tangs interconnected by side links. When mounted on a cutter bar, the tangs of the drive links ride in a peripheral groove centered longitudinally in the bar. The undersides of the side links run on the bar's outer parallel rails that define the groove. In one type of chain referred to herein as side link cutter chain, several of the side links include cutting elements that extend outwardly from the chain when it is mounted on the bar. Examples of such chain are disclosed in patents such as U.S. PAT. No. 2,508,784, U.S. PAT. No. 2,897,857 and U.S. PAT. No. 4,122,741. In another type of chain referred to herein as center drive cutter chain, several of the centrr drive links include outwardly extending cutting elements. An example of such chain is disclosed in U.S. PAT. No. 4,567,803.

One advantage that a center drive cutter chain has over a side link cutter chain is the side-to-side support that the depending tangs which extend into the peripheral groove provide to the cutting element. The lateral support of the tang of a cutter link lessens lateral movement of the cutter as it cuts into a workpiece.

However, a problem with both prior side link and center drive cutter chains is the vibration produced during the cutting process. As the tooth of a cutting element penetrates the wood, the cutter link is rocked rearwardly by the resistance of the wood. This rearward rocking pivotally raises the depth gauge against the wood, which limits the penetration of the cutting tooth temporarily. The cutting link is then rocked forwardly by the longitudinal tension of the chain and the cutting tooth again penetrates deeper into the wood. This repeated rocking causes the center cutter link to alternately dig into and out of the wood in a vibratory action called "porpoising." Porpoising wastes energy and reduces cutting efficiency.

The vibration problem in side link cutter chain is addressed in U.S. PAT. No. 4,122,741 to Engman et al. For each side cutter link and its oppositely disposed side link, the rear point of support on the bar rail is removed by levelling the rear underside of the link. This enables the cutting link to swivel around its forward point of support on the bar rail in response to resistance of the wood lowering the cutting tooth and its depth of penetration. Engman, however, does not disclose how the vibration in a center drive cutter chain could be reduced.

SUMMARY OF THE INVENTION

An object of the invention, therefore, is to provide an improved center drive cutter chain.

Another object of the invention is to reduce the vibration in a center drive cutter chain.

In accordance with these objects, a center drive cutter chain comprises a plurality of center cutter links each having a depending tang, a cutting tooth formed on the link and a depth gauge positioned forwardly of the tooth. Each cutter link also has forward and rearward pivot openings. Pivotally connected to the rear pivot opening of each center cutter link is a pair of oppositely disposed side links each having forward and rearward pivot openings and forward and rearward bar engaging undersides. To interconnect each center cutter link to the pair of following side links, means such as pivot pins extend through the rearward pivot opening of the cutter link and forward pivot openings of said side links. The geometry of the side links is such that the width of each of the side links between its forward pivot opening and forward bar engaging underside is less than the width between its rearward pivot opening and rearward bar engaging underside. When the axes of the pins extending through the pivot openings of the side links and the center cutter link are substantially in one plane, the forward bar engaging undersides of the side links are spaced apart from the adjacent rails of the cutter bar. This spacing enables the center cutter link to pivot about its forward pivot opening toward the bar rails as the link encounters resistance in the wood. The center cutter link thereby does not penetrate the wood to the same extent as without the spacing, causing the chain to cut more smoothly and with less vibration.

DETAILED DESCRIPTION

Figure 1:
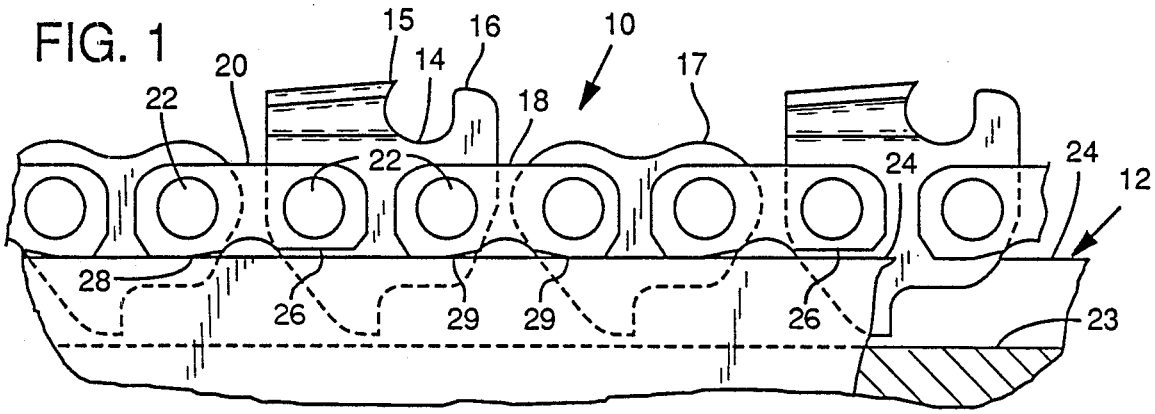
FIG. 1 is a side view illustrating the links of a center drive cutter chain constructed in accordance with the invention under longitudinal tension on a bar.

Referring now to FIG. 1, a portion of a center drive cutter chain 10 constructed in accordance with the invention is shown mounted on a substantially straight portion of a saw or cutter bar 12 along which the chain travels. The chain 10 is constructed of chain links that include a series of center drive cutter links 14, each having a cutter tooth 15 and depth gauge 16, alternating with non-cutter drive links 17. Each cutter link is connected to the next forward drive link 17 by an opposed pair of symmetrical side links 18 and to the next rearward drive link 17 by an opposed pair of nonsymmetrical side links 20. The drive cutter links 14, non-cutter drive links 17, symmetrical side links 18 and nonsymmetrical side links 20 are all pivotally interconnected by means such as rivets or pins 22 extending through pivot openings in the links, which openings have a diameter of a few thousandths of an inch greater than the pin diameter. The chain 10 is adapted to circulate around the bar 12 within the peripheral groove 23 defined by a pair of rails 24, the depending tangs of the drive links engaging teeth on a drive sprocket (not shown).

Figure 2:
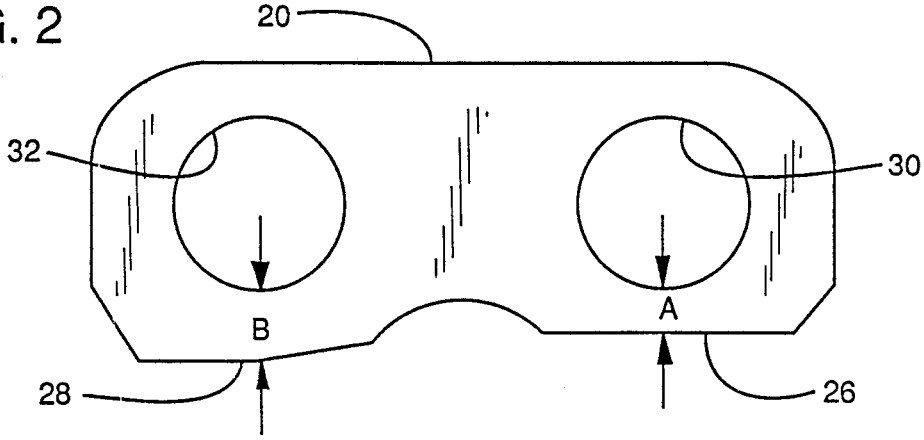
FIG. 2 is a side view of a side link of the chain of FIG. 1 constructed in accordance with the invention.

The chain 10 is slidably supported on the rails 24 of the bar 12 by spaced-apart forward and rearward bar engaging undersides 26, 28 of the side links 20 and the forward and rearward bar engaging undersides 29 of side links 18. Referring now to FIG. 2, it can be seen that the width A of a side link 20 between its forward pivot opening 30 and its underside 26 is less than the width B between its rearward pivot opening 32 and its underside 28. Thus, when the chain is positioned on the straight portion of the cutter bar 12 with the axes of the pivot pins 22 substantially in a plane parallel to the top surface of the saw bar rails 24, the forward undersides 26 of the side links 20 are spaced from the bar rails 24, as shown in FIG. 1. In this condition of the chain, the spacing between the undersides 26 and the rails 24 is preferably 0.010 to 0.020 of an inch.

Figure 3:
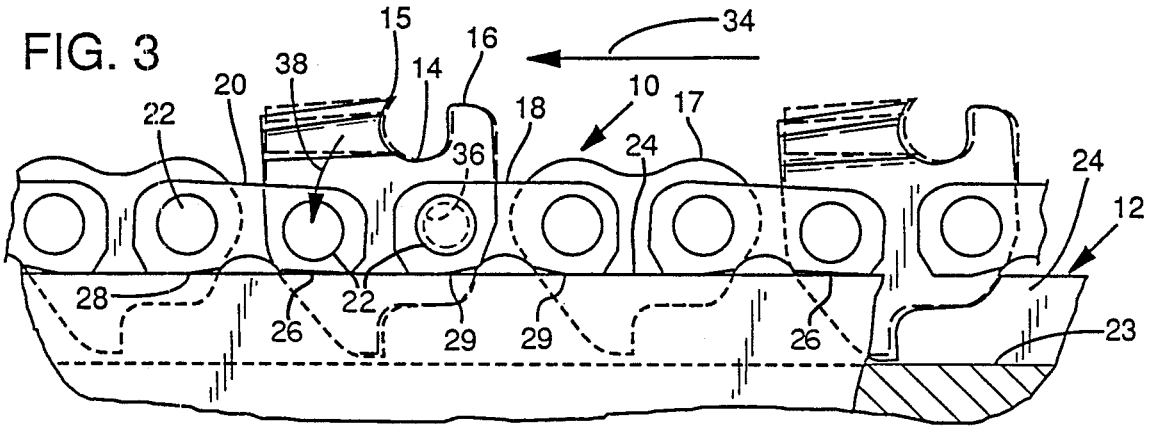
FIG. 3 is a side view similar to FIG. 1 but showing the relative positions of the links in response to resistance from engagement with a workpiece.

FIG. 3 illustrates how a drive cutter link 14 in the chain 10 will respond to resistance of wood encountered by the link. Before each cutting link 14 contacts the wood, it has the erect, dashed line position shown in FIG. 3. As the cutting tooth 15 of each link 14 is moved forwardly along the bar 12 (to the right in FIG. 3), it will penetrate the wood in a cutting operation. As it penetrates, the tooth 15 will encounter increasing resistance illustrated by arrow 34. This resistance will rock the link 14 rearwardly. Because of the gap between the undersides 26 and the rails 24, however, the link 14 will pivot about the pin 22 extending through the link's forward pivot opening 36 toward the rails 24, as illustrated by arrow 38, until the surfaces 26 of the following side links 20 engage the bar rails 24. At this point, the cutter link 14 will be in the solid line position shown in FIG. 3. This pivoting action increases the height of the depth gauge 16 relative to the cutting tooth 15 to reduce the tooth's penetration into the wood. As the wood resistance eases, the link 14 may pivot forwardly under the urging of the chain's longitudinal tension back to the erect, dashed line position. The total effect is that the porpoising action of the cutters is minimized and the chain will cut smoother with less vibration and with greater efficiency.

Having illustrated and described the principles of my invention with respect to several preferred embodiments, it should be apparent to those skilled in the art that the invention may be modified in arrangement and detail without departing from such principles. I claim all such modifications falling within the scope and spirit of the following claims.

I claim:

1. A cutting chain for a chain saw including a cutter bar about which the chain circulates, said bar having a substantially straight portion along which the chain travels and a peripheral groove defined by a pair of opposite side rails, said cutting chain adapted to circulate around said bar in a predetermined direction and comprising:

a center cutter link having a tang adapted to ride within said groove and a cutting tooth formed in the link, the cutter link also having forward and rearward pivot openings;

a pair of oppositely disposed side links each having forward and rearward pivot openings and forward and rearward bar engaging undersides, the width of each of said links between its forward pivot opening and forward bar engaging underside being less than the width between its rearward pivot opening and rearward bar engaging underside; and pin means extending through the rearward pivot opening of the cutter link and forward pivot openings of said side links for pivotally interconnecting the cutter and side links at said openings and extending through the rearward pivot openings of said side links for interconnecting said links to a following link and through the forward pivot opening of said cutter link for interconnecting said link to a preceding link, whereby the forward bar engaging undersides of the side link are spaced from adjacent rails of said bar when the axes of the pivot means are substantially in a plane parallel to the surfaces of said rails.

2. The cutting claim of claim 1 including a plurality of center cutter links alternatinq with center non-cutter links, the center links interconnected by side links to form the chain.

3. A cutting chain for a chain saw including a cutter bar about which the chain circulates, said bar having a substantially straight portion along which the chain travels and a peripheral groove defined by a pair of opposite side rails, said cutting chain adapted to circulate around said bar in a predetermined direction and comprising:

a center cutter link having a tang adapted to ride within said groove, a cutting tooth formed in the link and a depth gauge mounted forwardly of said tooth, the cutter link also having forward and rearward pivot openings;

a pair of oppositely disposed side links each having forward and rearward pivot openings and forward and rearward bar engaging undersides;

pin means extending through the rearward pivot opening of the cutter link and forward pivot openings of said side links for pivotally interconnecting the cutter and side links at said openings and extending through the rearward pivot openings of said side links for interconnecting said links to a following link and through the forward pivot opening of said cutter link for interconnecting said link to a preceding link; and an interconnection between the side links and the center cutter link for spacing the forward bar engaging undersides of the side links from adjacent rails of said bar when the axes of the pin means are substantially in a plane parallel to the surfaces of said rail.

4. A cutting chain for a chain saw including a cutter bar about which the chain circulates, said bar having a substantially straight portion along which the chain travels and a peripheral groove defined by a pair of opposite side rails, said cutting chain adapted to circulate around said bar in a predetermined direction and comprising:

a pair of center links each having a tang adapted to ride within said groove and forward and rearward pivot openings, the forward-most of said center links being a cutter link having a cutting tooth and a depth gauge positioned forwardly of said tooth;

a pair of oppositely disposed side links overlapping said center links, each side link having forward and rearward pivot openings and forward and rearward bar engaging undersides, the width of each of said links between its forward pivot opening and forward bar engaging underside being less than the width between its rearward pivot opening and rearward bar engaging underside; and pin means extending through the rearward pivot opening of the cutter link and forward pivot openings of said side links for pivotally interconnecting the cutter and side links at said openings and extending through the rearward pivot openings of said side links and the forward pivot openings of the rearward-most center link for interconnecting said links, whereby the forward bar engaging undersides of the side links are spaced apart from adjacent side rails of said bar when the axes of the pin means are in a plane parallel to the surface of the bar rails.

* * * * *